US007543913B2

(12) United States Patent
Buchanan et al.

(10) Patent No.: US 7,543,913 B2
(45) Date of Patent: Jun. 9, 2009

(54) PRINTHEAD SYSTEMS HAVING MULTIPLE INK CHAMBERS WITH BALANCED AND SHORT INK PATHS

(75) Inventors: Jeffery James Buchanan, Lexington, KY (US); Kin Ming Kwan, Lexington, KY (US); Ganesh Vinayak Phatak, Lexington, KY (US); Audrey Dale Rodgers, Lawrenceburg, KY (US)

(73) Assignee: Lexmark International, Inc., Lexington, KY (US)

( * ) Notice: Subject to any disclaimer, the term of this patent is extended or adjusted under 35 U.S.C. 154(b) by 398 days.

(21) Appl. No.: 11/100,877

(22) Filed: Apr. 7, 2005

(65) Prior Publication Data

US 2006/0227173 A1 Oct. 12, 2006

(51) Int. Cl.
*B41J 2/04* (2006.01)
*B41J 2/175* (2006.01)

(52) U.S. Cl. ..... 347/54; 347/86

(58) Field of Classification Search ..... 347/40, 347/49, 65, 86, 38

See application file for complete search history.

(56) References Cited

U.S. PATENT DOCUMENTS

| | | | | | |
|---|---|---|---|---|---|
| 3,823,409 | A * | 7/1974 | Carrell | 347/38 |
| 4,714,936 | A * | 12/1987 | Helinski et al. | 347/38 |
| 5,659,345 | A * | 8/1997 | Altendorf | 347/87 |
| 6,344,904 | B1 * | 2/2002 | Mercer | 358/296 |
| 7,152,954 | B2 * | 12/2006 | Katayama | 347/49 |
| 2002/0130934 | A1 * | 9/2002 | Chan et al. | 347/92 |
| 2004/0080578 | A1 * | 4/2004 | Dunfield et al. | 347/54 |

* cited by examiner

*Primary Examiner*—Matthew Luu
*Assistant Examiner*—Lisa M Solomon
(74) *Attorney, Agent, or Firm*—Sutherland, Asbill & Brennan

(57) ABSTRACT

Ink delivery systems achieve balanced ink flow by positioning two or more ink chambers around ink ejection mechanisms in a printhead. A plurality of pie-shaped ink chambers may be arranged in a circle above an ink ejection mechanism, which provides short ink paths from each ink chamber, and ink paths having approximately the same length. This fosters even ink flow rates and equal pressure drop/loss of ink supplies, thereby improving ink feeds to a printhead and providing improved jetting efficiency and printhead performance.

26 Claims, 8 Drawing Sheets

PRINTHEAD SYSTEMS HAVING MULTIPLE INK CHAMBERS WITH BALANCED AND SHORT INK PATHS

FIELD OF THE INVENTION

The present invention relates generally to inkjet printers, and more specifically, to systems for printhead ink delivery in inkjet printers.

BACKGROUND OF THE INVENTION

Inkjet printers are particularly effective at rendering high quality color images by using numerous small nozzles on a printhead to spray drops of liquid ink directly onto paper as the printhead traverses the paper. Inkjet printers typically include one of two types of ink ejection mechanisms to expel ink from a printhead to form a desired image—thermal bubbles or piezo-electric technology. In a thermal bubble inkjet system small heating elements, such as resistors, are heated to vaporize a small amount of ink to create a bubble. As the bubble expands, a small amount of ink is ejected from a nozzle associated with the heating element. Each inkjet printhead may contain hundreds of nozzles individually actuated to fire ink droplets. By selectively energizing heating elements as a printhead traverses a paper, the ink is expelled in a pattern to form a desired image. Piezoelectric systems achieve control of each printhead nozzle using a piezoelectric element instead of a heating element. Electric current applied to piezo crystals causes the crystals to vibrate, forcing a small amount of ink out of a nozzle.

Regardless of the inkjet ejection mechanisms used to expel ink from a printhead to form an image, the generation of high quality images requires, in part, that printheads handle multiple colors while generating a small ink drop mass to effect high resolution images. Although conventional inkjet printers used only three colors to generate images, today's inkjet printers may use eight or more colors to enrich the color table and accuracy of a printed image. The increasing number of colors presents a challenge to conventional ink delivery systems. These systems include disposable inkjet printheads having a single piece ink container, on-carrier systems having a printhead carrier that is separate from a replaceable ink chamber, and off-carrier systems where a printhead carrier is connected to a separated ink chamber by a tubing system.

Conventional disposable inkjet printheads are limited to four ink chambers (i.e., four colors) in a single piece body due to molding and tooling design constraints. Unless two disposal printheads are used in such a system, only on-carrier or off-carrier systems are able to accommodate more than four inks at a time. Unfortunately, current on-carrier systems require a manifold with ink flow channels between the ink chambers and the printhead to provide a passage of the ink to the printhead. The complexity and length of ink flow channels increases as the number of ink chambers increase and are positioned further from the ink ejection mechanism. This may lead to pressure drops of the ink in each ink flow channel, which may affect the feeding rate of the ink to the printhead resulting in poor jetting efficiency or ink starvation in the printhead. Therefore, what is needed is an on-carrier ink delivery system that permits the use of multiple ink chambers while minimizing and balancing the unequal length of ink flow channels.

BRIEF SUMMARY OF THE INVENTION

Ink delivery systems of the present invention achieve equal and balanced ink flow by positioning two or more ink chambers around ink ejection mechanisms in a printhead. According to one embodiment of the invention, a plurality of pie-shaped ink chambers may be arranged in a circle above an ink ejection mechanism. This results in a short ink path from each ink chamber and ink paths for each ink chamber having approximately the same length. This fosters even ink flow rates and equal pressure drop/loss of ink supplies, thereby improving ink feeds to a printhead and providing improved jetting efficiency and printhead performance.

According to one embodiment of the present invention, there is disclosed an ink delivery apparatus. The apparatus includes a plurality of ink chambers that substantially encircle a center point, where the plurality of ink chambers are operable to contain ink, and a plurality of ink flow paths, where each ink flow path corresponds to a respective ink chamber of the plurality of ink chambers. The apparatus also includes an ink ejection mechanism operable to receive, via the plurality of ink flow paths, the ink contained within the plurality of ink chambers.

According to one aspect of the invention, the plurality of ink flow paths are substantially the same length and may contain ink under substantially the same pressure drop. According to another aspect of the invention, the ink ejection mechanism is positioned substantially below the center point. The ink ejection mechanism may be a thermal bubble system or a piezoelectric system, as are known in the art. According to yet another aspect of the invention, each of the ink chambers may include an ink passage positioned in close proximity to the center point. Additionally, the apparatus may also include a manifold in which a plurality of ink flow paths are disposed substantially vertically within. The plurality of ink chambers may also include four or more ink chambers, each of which may be triangular or pie-shaped. Furthermore, the ink chambers may be removeable.

According to another embodiment of the invention, there is disclosed an ink delivery apparatus. The apparatus includes a printhead carrier having a center point, and a plurality of ink chambers positioned on the carrier, where the plurality of ink chambers substantially surround the center point, and where the plurality of ink chambers contain ink. The apparatus also includes a plurality of ink flow paths, where each ink flow path of the plurality of ink flow paths corresponds to a respective ink chamber of the plurality of ink chambers, and an ink ejection mechanism positioned substantially below the center point, where the ink ejection mechanism is operable to receive and eject ink stored within the plurality of ink chambers.

According to one aspect of the invention, the plurality of ink chambers are replaceable. The apparatus may also include a plurality of substantially vertical ink flow paths that transmit the ink from the plurality of chambers to the ink ejection mechanism. According to another aspect of the invention, the apparatus may include a manifold positioned substantially above the ink ejection mechanism, and the plurality of ink flow paths may be defined by, or contained within, the manifold. Additionally, the plurality of ink paths may extend through the height of the manifold and converge towards each other at a bottom of the manifold.

According to yet another embodiment of the invention, each of the plurality of ink chambers may include an ink passage positioned in close proximity to the center point. Furthermore, the ink ejection mechanism may be a thermal bubble system or a piezoelectric system, as are known in the art.

According to yet another embodiment of the invention, there is disclosed an ink delivery apparatus that includes a plurality of ink chambers and an ink ejection mechanisms. In the apparatus, at least one portion of each of the plurality of ink chambers share substantially a common point, and an ink ejection mechanism positioned below the common point. The ink ejection mechanism is operable to receive and eject ink stored within the plurality of ink chambers.

According to one aspect of the invention, the plurality of ink chambers are replaceable. The ink chambers may also be positioned to substantially form substantially the shape of a circle, semicircle, square, rectangle, hexagon, or any polygon shapes. According to another aspect of the invention, the apparatus may also include a plurality of substantially vertical ink flow paths that transmit the ink from the plurality of chambers to the ink ejection mechanism. According to yet another aspect of the invention, the apparatus may include a manifold positioned substantially above the ink ejection mechanism, where the plurality of ink flow paths extend through the height of the manifold, and where the plurality of ink paths converge towards each other at a bottom of the manifold.

According to yet another embodiment of the invention, there is disclosed a method for ink delivery. The method includes the steps of positioning a plurality of ink chambers around a center point, transmitting, via substantially vertical ink paths, ink stored within the plurality of ink chambers to an ink ejection mechanism positioned below the center point, and ejecting the ink from the ink ejection mechanism.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 3A:
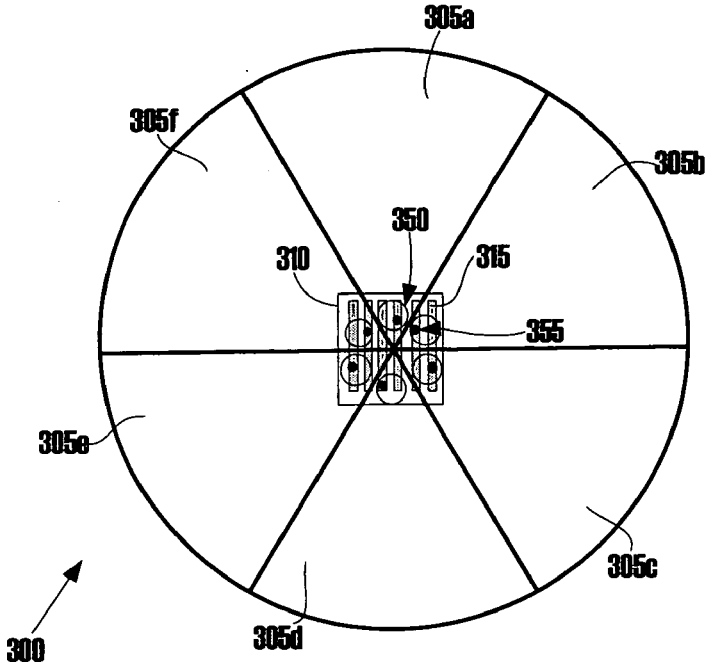

FIG. 3*a* shows a top view of a pie-shape ink chamber on-carrier system, according to an illustrative embodiment of the present invention.

Figure 3B:
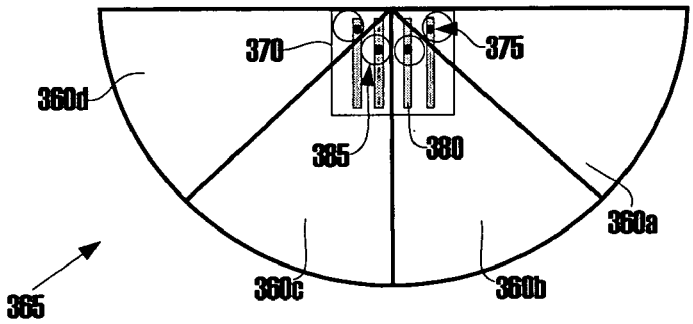

FIG. 3*b* shows a top view of a semi-circular on-carrier system having pie-shaped ink chambers, according to an illustrative embodiment of the present invention.

Figure 4A:
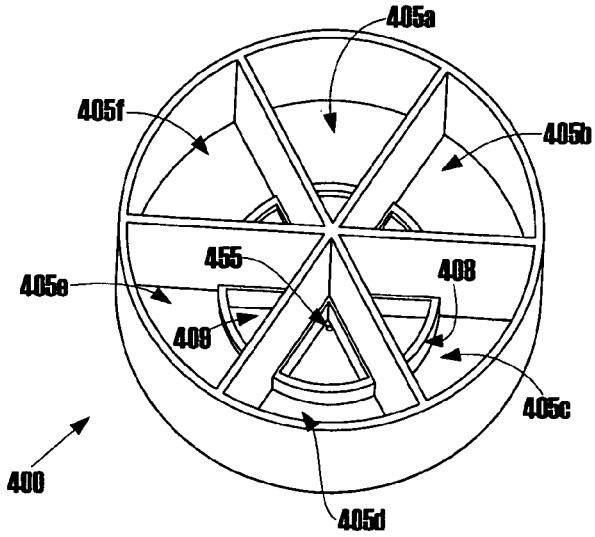

FIG. 4*a* shows a perspective view of a six color disposable printhead, according to an illustrative embodiment of the present invention.

Figure 4B:
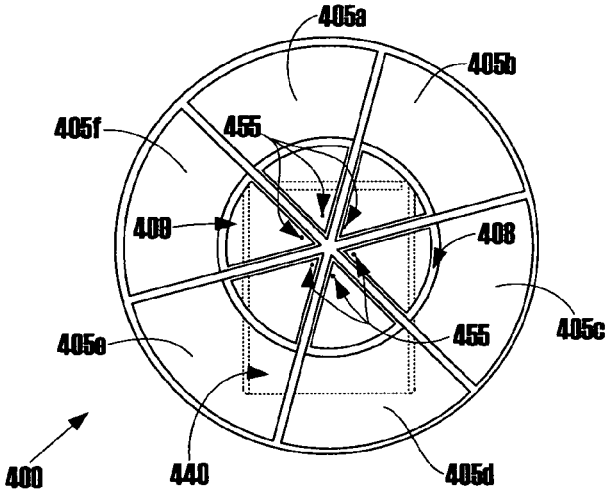

FIG. 4*b* shows a top view of the six color disposable printhead of FIG. 4*a*, according to an illustrative embodiment of the present invention.

Figure 4C:
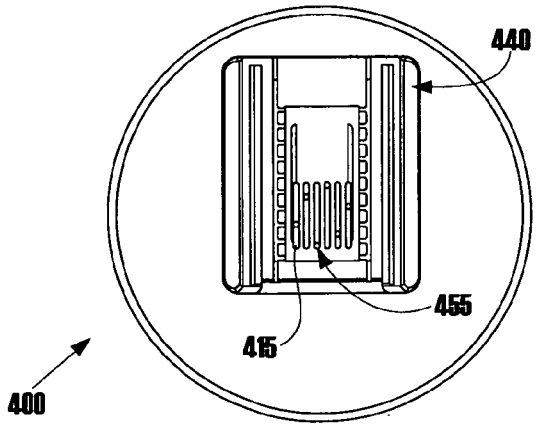

FIG. 4*c* shows a bottom view of the six color disposable printhead of FIG. 4*a*, according to an illustrative embodiment of the present invention.

Figure 5A:
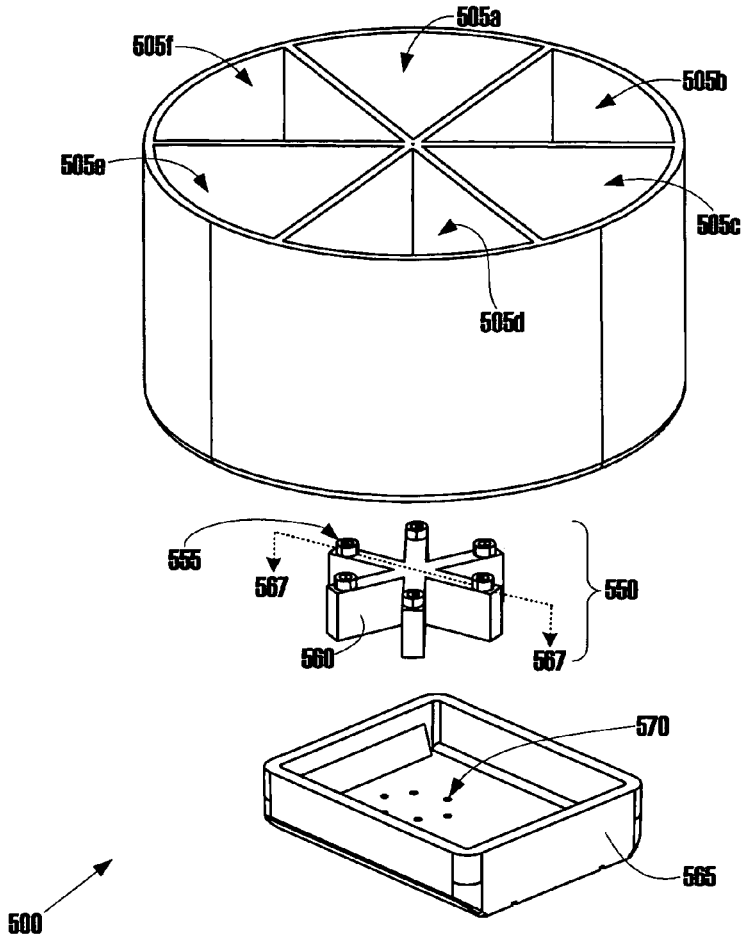

FIG. 5*a* shows a disposable printhead including a manifold, according to an illustrative embodiment of the present invention.

Figure 5B:
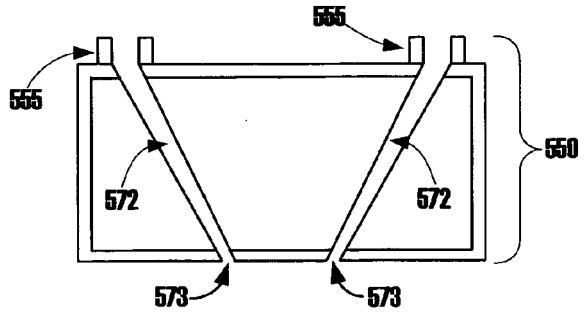

FIG. 5*b* shows a side view of the manifold of FIG. 5*a*, according to an illustrative embodiment of the present invention.

Figure 6A:
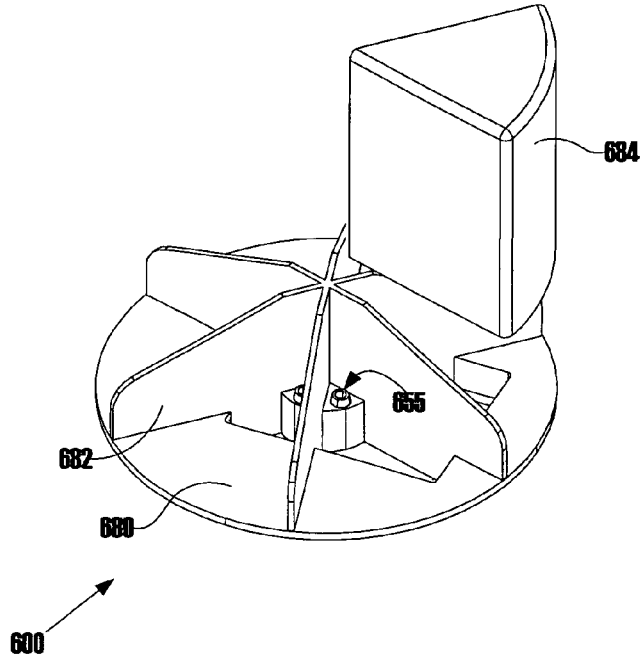
Figure 6B:
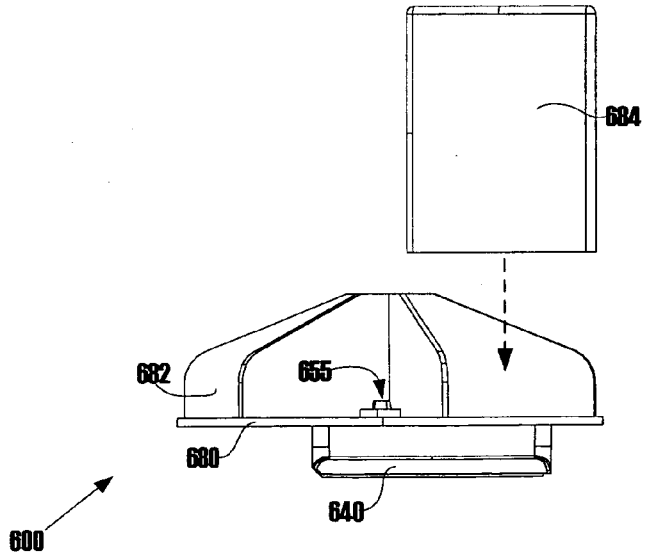
Figure 7:
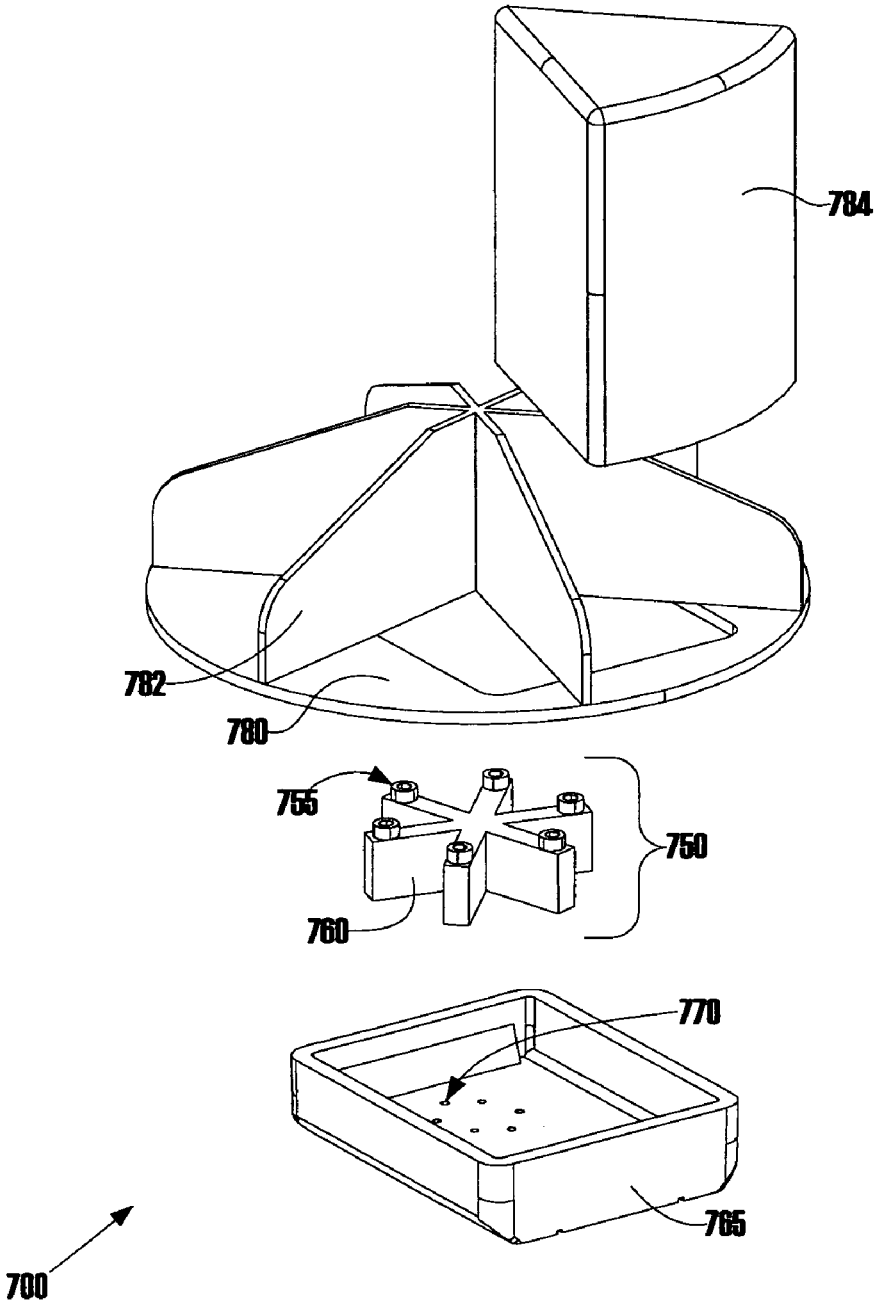

FIG. 6*a* shows a perspective view of an on-carrier printhead having replaceable ink chambers, according to an illustrative embodiment of the present invention FIG. 6*b* shows a side view of the an on-carrier printhead of FIG. 6*a*, according to an illustrative embodiment of the invention FIG. 7 shows an on-carrier printhead having replacement ink chambers and a manifold, according to an illustrative embodiment of the invention.

Figure 8:
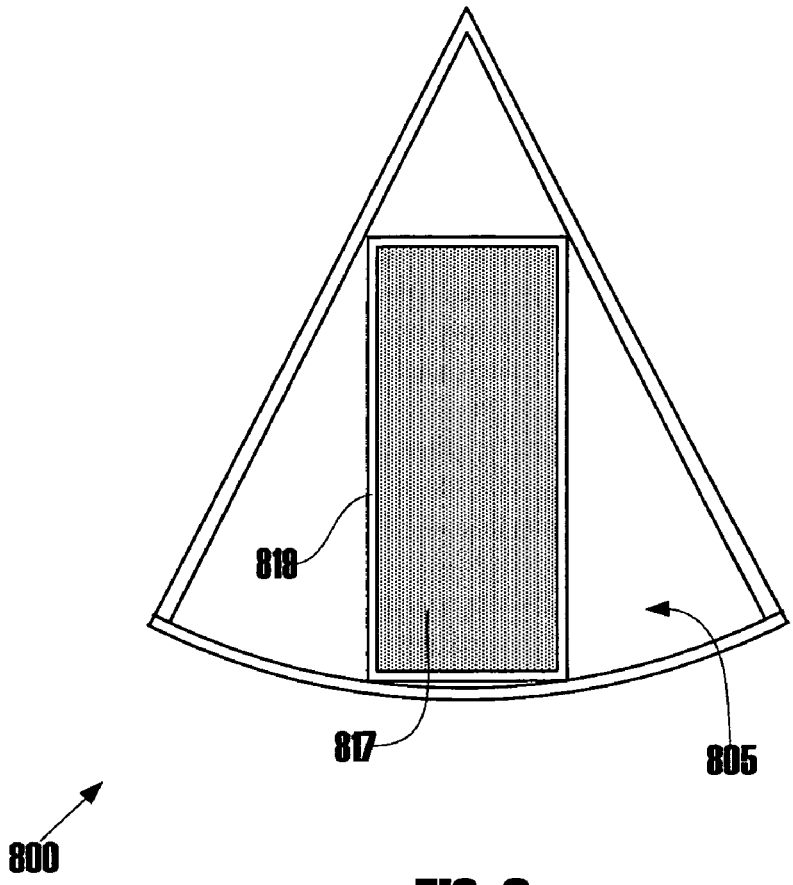

FIG. 8 shows an ink chamber, according to an illustrative embodiment of the present invention.

DETAILED DESCRIPTION OF THE INVENTIONS

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
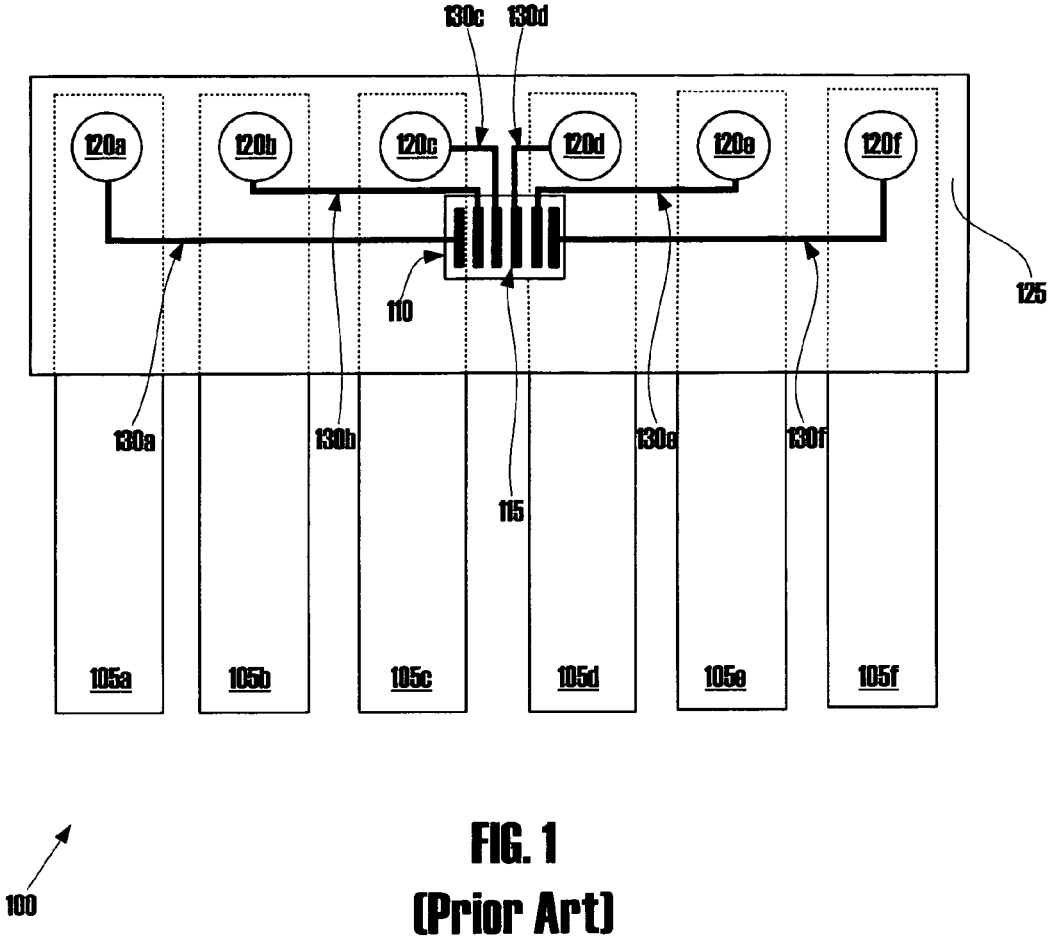
FIG. 1 (Prior Art)
FIG. 1 shows a prior art design of an on-carrier ink delivery system having unbalanced ink flow paths.

FIG. 1 shows a prior art design of an on-carrier ink delivery system 100 that includes ink flow channels 130*a*-130*f* of various lengths. The on-carrier ink delivery system 100 of FIG. 1 includes six generally rectangular ink chambers 105*a*-105*f*. Ink within the respective ink chambers 105*a*-105*f* is gravity fed from the chambers 105*a*-105*f* through filter towers 120*a*-120*f* corresponding to each chamber 105*a*-105*f*, and then via the ink flow channels 130*a*-130*f* to an ink ejection mechanism, which in FIG. 1 includes a heater chip 110, as is commonly used in a thermal bubble inkjet system. The heater chip 110 includes a series of vias 115 corresponding to each color, where ink travels through each via to nozzles (not illustrated) located underneath the heater chip 110. As is generally known in the art, for each ink color there is a row of nozzles underneath the heater chip 110, which is positioned in the center of the on-carrier delivery system 100.

As shown in FIG. 1, the ink chambers 105*c*, 105*d* closest to the heater chip 110 have the shortest ink flow channels 130*c*, 130*d* from their respective filter towers 120*c*, 120*d* to the heater chip 110. The ink flow channels 130*a*-130*f* are constructed within a manifold 125, which includes six circular openings molded therein, through which ink enters the manifold 125 via the filter towers 120*a*-120*f*. The ink flow channels 130*a*-130*f* are internally molded in the manifold 125 or formed by two pieces sandwiched together to create the manifold 125. Typically, the ink flow channels 130*a*-130*f* may be constructed at different angles and shapes, depending on the design of the manifold 125.

It will be appreciated that there is a limited amount of space for the ink flow channels 130*a*-130*f* in the manifold 125 and that an increased number of colors leads to a higher number of ink flow channels and a wider printhead. With the existing design of on-carrier ink delivery system as shown in FIG. 1, the ink flow channels 130*a*-130*f* may have unequal distances to reach the heater chip 110. This may lead to various pressure drops of the ink in each ink flow channel, which may affect the feeding rate of the ink to the printhead resulting in poor jetting efficiency or ink starvation in the printhead. Adding additional ink colors only further exacerbates the problem. Thus, when another ink color is desired, adding an ink chamber results in a longer ink flow channel required to feed the ink from the additional ink chamber because the ink chamber will be placed outside of the existing ink chambers and remote from the ink ejection mechanism.

Although FIG. 1 is illustrated as including a heater chip 110, as typically used in a thermal bubble type of ink ejection mechanism, it will be appreciated that the same problems may occur where piezo-electric technology is used as the ink ejection mechanism, as ink in either system is typically directed to a nozzles located on a printhead residing at a central position in on-carrier delivery systems. Thus, the problems caused by lengthy and unequal ink channel geometry exist irrespective of the ink ejection mechanism used in an inkjet printer.

Figure 2:
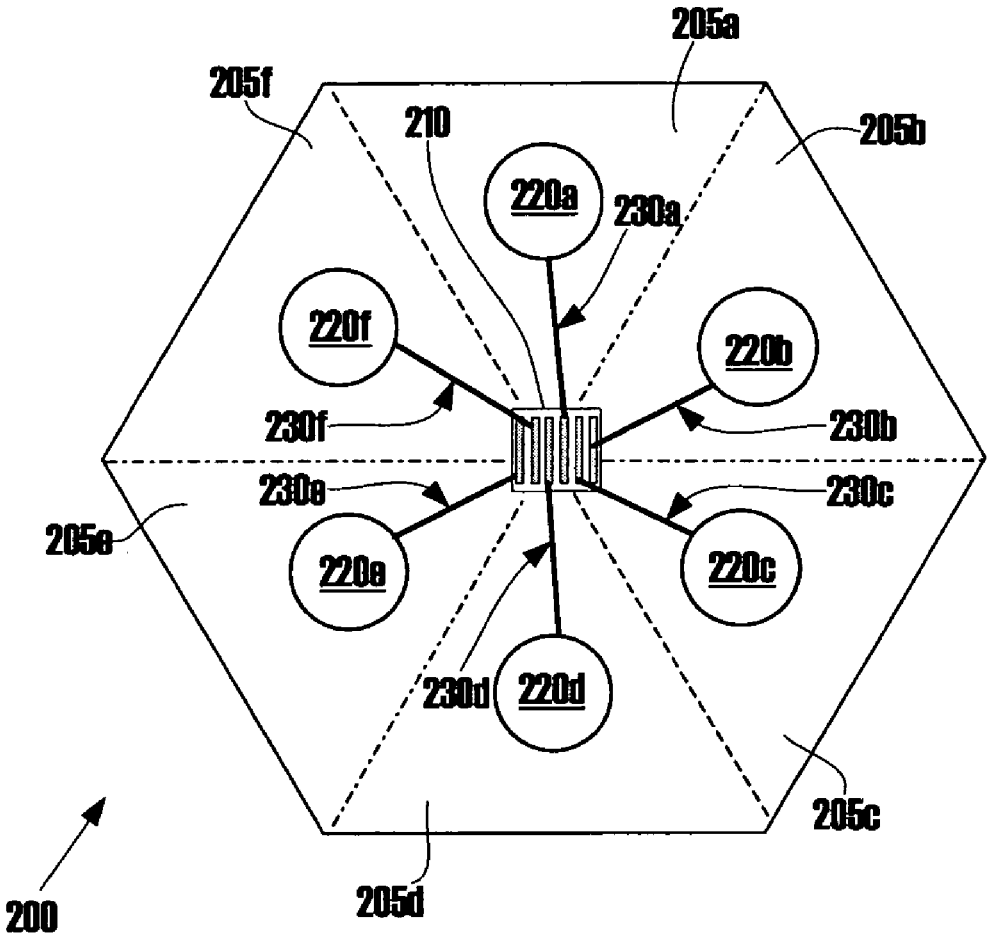
FIG. 2 shows a triangular ink chamber on-carrier system having equal-length ink flow paths, according to an illustrative embodiment of the present invention.

FIG. 2 shows a triangular ink chamber on-carrier system 200 having equal-length ink flow paths 230*a*-230*f* from each filter tower 220*a*-220*f* to a central heater chip 210, according to one embodiment of the present invention. According to one aspect of the invention, the on-carrier system 200 may be a printhead. The embodiment illustrated in FIG. 2 includes six ink chambers 205*a*-205*f*, each of which may contain a different ink color. The heater chip 210 is in the center of the on-carrier system 200. All of the six ink chambers 205*a*-205*f* are distributed directly around the heater chip 210 so that the ink flow paths 230*a*-230*f* are as short as possible and similar or equal in length. It will be appreciated that these short flow paths are advantageous over the unequal, and often lengthy, ink flow channels 130*a*-130*f* illustrated in FIG. 1 because the ink flow paths 230*a*-230*f* will result in improved ink feeds to a printhead, resulting in improved jetting efficiency and performance of the printhead. Like the conventional system described above with respect to FIG. 1, the triangular ink chamber on-carrier system 200 may include a plastic-injected manifold located between the ink chambers 205*a*-205*f* and the heater chip 210 in order to provide for the ink flow channels 230*a*-230*f*. However, as described in greater detail below with respect to FIGS. 3 and 4*a*-4*b*, on-carrier systems according to the present invention may also be constructed without the use of a manifold, thereby providing a simplified structure with improved performance as compared to the prior art.

Although the ink chambers 205*a*-205*f* illustrated in FIG. 2 are illustrated as having generally the same shape, and as being generally the same size, it will be appreciated that one or more of the ink chambers 205*a*-205*f* may be larger than other chambers. Thus, the triangular ink chambers 205*a*-205*f* do not necessarily share equal space in a printhead and on a carrier. For instance, according to one illustrative embodiment, two of the ink chambers 205*a*-205*f* illustrated in FIG. 2 may be combined into a large, single chamber when the frequent usage of a particular color requires a greater volume of a particular ink, as is common with black ink. In such an embodiment, each ink chamber will be associated with a single ink flow path to the central heater chip 210 so that the ink paths from each ink chamber will have approximately the same length, resulting with an even flow rate and equal amount of pressure drop/loss, unlike conventional systems like those described above with reference to FIG. 1. In an alternative embodiment to using larger ink chambers for greater volume inks, an increased volume of particular color of ink may be achieved by designating two or more chambers to a particular ink color, thereby maintaining generally the same size and shape of each ink chamber 205*a*-205*f*.

Further, though the ink chambers illustrated in FIG. 2 are illustrated as triangular in shape, and residing on a hexagonal structure, it will be appreciated that alternative ink chamber and carrier shapes may be used. For instance, as shown in FIG. 3*a*, which is described in detail below, an on-carrier printhead 300 may be circular with pie-shaped ink chambers 305*a*-305*f* surrounding a central heater chip 310. The present invention may be implemented using a printhead of virtually any shape, including a square or rectangular shape, so long as the ink chambers provide approximately the same length ink flow channels to the ink ejection mechanism. According to another illustrative example, the present invention may be implemented with square-shaped ink chambers distributed around a heater element, such as four ink chambers each residing in a respective quadrant on a square carrier. It will be appreciated that additional arrangements facilitating the use of a greater number of ink chambers placed around a central heater chip may also be implemented.

The present invention is described in the above embodiments as including a heater chip. However, it should be appreciated by those of ordinary skill in the art that the present invention may also be implemented using alternative ink ejection mechanisms, including piezoelectric mechanisms. Because the problems caused by lengthy and unequal ink channel geometry may exist irrespective of the ink ejection mechanism, the structures described herein may be advantageous to inkjet printers using mechanisms other than those that use heater chips and thermal bubbles to eject ink. Thus, while the present invention is described throughout the present disclosure with reference to a thermal bubble ink ejection system that includes a heater chip, all of the embodiments described herein may also be implemented using a piezoelectric or alternative ink ejection mechanism.

Next, FIG. 3*a* shows a top view of a circular on-carrier system 300, according to an embodiment of the present invention. According to one aspect of the invention, the circular on-carrier system may be a printhead. The system 300 is similar to the triangular ink chamber on-carrier system 200 of FIG. 2 in that there are a plurality of ink chambers 305*a*-305*f* surrounding a central heater chip 310. Whereas the ink chambers 205*a*-205*f* in FIG. 2 were triangular, the ink chambers 305*a*-305*f* shown in FIG. 3*a* are pie-shaped. Notably, the top view of FIG. 3*a* illustrates a relationship between the ink chambers 305*a*-305*f* and the heater chip 310 that does not require the use of a manifold located there between. The heater chip 310 is located immediately beneath the center point of the circular on-carrier system, such that the tip of each pie-shaped ink chamber 305*a*-305*f* is located above the heater chip 310.

Each ink chamber 305*a*-305*f* includes a filter tower that permits the ink within each respective ink chamber to pass from the ink chamber 305*a*-305*f* to an ink flow path 355 that carries the ink to the vias 315 within the heater chip 310. An outline of the positions 350 of the circular filter towers are illustrated in FIG. 3*a*. In the embodiment of FIG. 3*a*, the filter towers are located directly above the heater chip 310 so that no manifold is required, and the ink may pass from the filter towers via filter tower passages 355 to vias 315 in the heater chip 310. The vias 315 are approximately 1 millimeter wide and ½ and inch in length. The ink passes from the vias 315 to printhead nozzles. It will be appreciated that eliminating the manifold simplifies construction of the on-carrier system 300, as no plastic injection molding of a manifold is required. This arrangement also provides the shortest distance between the filter tower and the heater chip, thereby minimizing pressure drop in the filter tower passages 355 and reducing the likelihood for obstructions between the ink chambers 305*a*-305*f*, which helps preserve proper ink feed rates to printhead nozzles.

It will be appreciated that other arrangements of ink chambers may be beneficial in minimizing the size or depth of a printhead, which may be advantageous where space for a carrier structure is restricted. For instance, as shown in the illustrative example of FIG. 3*b*, pie-shaped ink chambers 360*a*-360*d* may be combined to form a semi-circular printhead 365, where a heater chip 370 is positioned at the center of the straight side of the semi-circle. Like the illustrative example of FIG. 3*a*, each ink chamber 360*a*-360*d* includes a filter tower that permits the ink within each respective ink chamber to pass from the ink chamber 360*a*-360*d* to an ink flow path 375 that carries the ink to the vias 380 within the heater chip 370. An outline of the positions 385 of the circular filter towers are illustrated in FIG. 3*b*. Such a construction may minimize the size of the printhead and a carrier at the expense of the volume of ink retained within ink chambers.

FIG. 4*a* shows a perspective view of a circular six color disposable printhead 400, according to an embodiment of the present invention. The printhead 400 is similar to the circular on-carrier system 300 illustrated in FIG. 3, as it includes six pie-shaped ink chambers 405*a*-405*f*. The ink chambers 405*a*-405*f* may be constructed as a single piece by plastic via injection molding, or the like.

In the device shown in FIG. 4*a*, ink from the ink chambers 405*a*-405*f* is gravity fed to the heater chip 440 positioned underneath the ink chambers 405*a*-405*f* via filter towers 409 within each ink chamber 405*a*-405*f*. According to one aspect of the invention, a filter frame 408 is operable to retain the position of an ink filter (not illustrated) positioned directly over respective filter tower passages 455 from which ink passes out of the ink chamber. Ink filters, as are known in the art, may be used to regulate the ink flow leaving ink chambers. As shown in FIG. 4*a*, the filter towers 409 may be similar to the shape of the ink chambers 405*a*-405*f*, and the filter frame 408 preferably include walls that are shorter than the respective walls comprising the ink chambers. This permits a large portion of an ink filter retained within the filter frame 408 to be exposed to ink, as described in further detail below with respect to FIG. 8. According to one embodiment, the walls of the filter frame 408 may be constructed of a solid materials with gaps or through holes located therein. Additionally, although illustrated as pie-shaped, the filter towers 409 may be another shape, such as circular, as in FIG. 3, square, or the like.

FIG. 4*b* shows a top view of the six color disposable printhead 400 and illustrates the location of the heater chip 440 underneath the ink chambers 405*a*-405*f*. The heater chip 440 is also shown in FIG. 4*c*, which shows a bottom view of the six color disposable printhead 400. As is known in the art, the heater chip 440 may be constructed of a ceramic material, and it may be affixed underneath the ink chambers 405*a*-405*f* by one or more plastic chip pocket components (not illustrated). The heater chip includes vias 415 that receive ink from the ink chambers 405*a*-405*f* via filter tower passages 455. The ink is fed from the vias 415 to numerous nozzles that eject the ink onto a page as the printhead traverses the page. It will be appreciated that the design shown in FIGS. 4*a*-4*c* eliminates the need for a manifold design as in conventional systems as described in FIG. 1 because there is no need to converge the ink from a distant location in ink chambers to the heater chip 440. As a result, ink starvation in the vias 415 due from uneven pressure in the ink supply is prevented.

FIG. 5*a* shows a disposable printhead 500 including a manifold 550, according to one embodiment of the present invention. Because heater chips and other ink ejection mechanisms may be small, it may be difficult to feed ink directly from filter tower passages to a heater chip (or other ejection mechanism) positioned directly underneath, as described above with respect to the embodiments illustrated in FIGS. 4*a*-4*c*. Therefore, a manifold 550 may be used to connect the filter tower passages to vias of a heater chip. As shown in FIG. 5*a*, a plurality of ink chambers 505*a*-505*f* are positioned directly above the manifold 550. The manifold, which may be plastic, includes an inlet 555 on the top side of each of a plurality of manifold arms 560, where each manifold arm 560 corresponds to a respective ink chamber 505*a*-505*f*. Each inlet 555 is positioned directly below the filter tower passages through which ink flows out of the ink chambers 505*a*-505*f*. The manifold 550 provides an ink path from each inlet 555 to an outlet on the underside of the manifold 550.

FIG. 5*b* shows a side view of the manifold 550 of FIG. 5*a* taken along cross section 567, according to one embodiment of the present invention. As illustrated in FIG. 5*b*, the ink paths 572 converge as they proceed from the inlets 555 on the top side of the manifold toward the outlets 573 on the bottom of the manifold, which allows the ink chambers 505*a*-505*f* to provide ink to vias that are close together. The outlets 573 on the underside of the manifold 550 engages a nose piece 565, as shown in FIG. 5*a*, that includes a chip pocket that retains a heater chip and includes pass throughs 570 to provide ink to chip vias (not illustrated). It will be appreciated that although the manifold 550 is illustrated in FIGS. 5*a* and 5*b* as a separate component from the nose piece 565, the two components may be combined into a single component. For instance, the bottom of the manifold 550 may be affixed to the top side of the nose piece 565, such as by welding or the like. Additionally, although not illustrated, the manifold may be constructed to retain the heater chip, so that the ink channels within the manifold run more horizontally than vertically as they converge toward the heater chip. Because the heater chip is retained within the manifold, there is little vertical displacement between the ink channels and the heater chip, which results in the ink channels horizontal position within the manifold.

FIGS. 6*a* and 6*b* show an on-carrier printhead 600 having replaceable ink chambers, according to one embodiment of the invention. The on-carrier printhead is similar to those described with respect to FIGS. 2-5*b*, as the printhead 600 may include a plurality of ink chambers grouped in a circle directly above an ink ejection mechanism, which is in FIGS. 6*a* and 6*b* includes a heater chip 640. Although only one ink chamber 684 is illustrated in FIGS. 6*a* and 6*b*, the printhead 600 includes a platform 680 having partitions 682 that define receptacles for receiving several replaceable ink chambers. According to a preferred embodiment of the invention, the on-carrier printhead 600 may accommodate at least two to twelve replaceable ink chambers.

As with previously discussed embodiments, ink leaves the ink chambers at a position close to the center of the printhead 600. As shown in FIGS. 6*a* and 6*b*, ink is gravity fed from an ink chamber toward the heater chip 640 through an ink nodule 655 built into the printhead 600. The replaceable ink chambers may include foam filters therein to regulate ink pressure, as is known in the art. To effect placement and engagement of an ink chamber 684 with the platform 680, the ink chambers may include a puncturable foil or like element covering a hole or opening in the underside of the ink chamber that is dislodged as an ink chamber 684 engages the corresponding ink nodule 655 when placed in position on the platform 680. According to one aspect of the invention, the ink nodule 655 channels ink directly below the ink chamber towards vias in the heater chip 640. However, an on-carrier printhead 600 may also be implemented using a manifold as discussed with respect to FIG. 5*a*.

FIG. 7 shows an on-carrier printhead 700 having replaceable ink chambers and a manifold 750, according to one embodiment of the invention. The printhead 700 is similar to the printhead 600 described with respect to FIGS. 6*a* and 6*b*, as the printhead 700 includes a platform 780 having partitions 782 that define receptacles for receiving 2 or more replaceable ink chambers. However, in the embodiment illustrated in FIG. 7, the platform 780 does not include integrated ink nodules that engage an opening in the underside of a replaceable ink chamber 784. Instead, the printhead 700 includes a manifold 750 that includes an inlet 755 on the top side of each of a plurality of manifold arms 560, where each manifold arm 760 corresponds to a respective replaceable ink chamber. Each inlet 755 may be aligned with a hole or opening in the underside of a corresponding ink chamber. According to one aspect of the invention, the inlets 755 may engage a puncturable foil or like element covering a hole or opening in the underside of the ink chamber that is dislodged as an ink chamber 784 is placed in position on the platform 780. The manifold 750 provides an ink path from each inlet 755 to an outlet on the underside of the manifold 750. The ink paths converge as they proceed from the inlets 755 on the top side of the manifold toward the outlets on the bottom of the manifold, which allows the replaceable ink chambers to provide ink to vias that are close together. The outlets on the underside of the manifold 750 engages a nose piece 765 that includes a chip pocket that retains a heater chip and includes pass throughs 770 to provide ink to chip vias (not illustrated). Like the manifold 550 of FIG. 5*a*, it will be appreciated that although the manifold 750 is illustrated in FIG. 7 as a separate component from the nose piece 765, the two components may be combined into a single component. For instance, the bottom of the manifold 750 may be affixed to the top side of the nose piece 765, such as by welding or the like. Additionally, although not illustrated, the manifold may be constructed to retain the heater chip, so that the ink channels within the manifold run more horizontally than vertically as they converge toward the heater chip. Because the heater chip is retained within the manifold, there is little vertical displacement between the ink channels and the heater chip, which results in the ink channels horizontal position within the manifold.

Next, FIG. 8 shows an ink chamber 800 according to one embodiment of the present invention. The ink chamber 800 may represent a single ink chamber for use with printheads of the present invention. The ink chamber 800 may be incorporated with additional ink chambers in a single chamber having multiple colors, and/or may be a replaceable ink chamber. The ink chamber 800 may also be used in embodiments that include, or fail to include, a manifold. As shown in FIG. 8, the ink chamber 800 includes a foam filter 817 and a free ink chamber 805, which are operable to regulate the back pressure, as is known in the art. The foam filter 817 is retained in pace by a filter frame 819. The filter frame 819 preferably includes permeable members that are shorter than the respective walls comprising the ink chambers, which permits the foam filter 817 to be exposed to the free ink chamber 805. According to one aspect of the invention, the filter frame contains holes therein through which ink can pass from the free ink chamber 805.

Many modifications and other embodiments of the inventions set forth herein will come to mind to one skilled in the art to which these inventions pertain having the benefit of the teachings presented in the foregoing descriptions and the associated drawings. For instance, various ink chamber shapes may be utilized to effect printheads according to the present invention. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An on-carrier ink delivery apparatus, comprising:

a printhead having an ink jet ejection mechanism;

a plurality of on-carrier ink chambers mounted over the printhead, the plurality of ink chambers substantially encircling a center point associated with the printhead, wherein the plurality of ink chambers are operable to contain ink; and a plurality of ink flow paths, wherein each ink flow path of the plurality of ink flow paths corresponds to a respective ink chamber of the plurality of ink chambers, wherein the ink ejection mechanism is operable to receive, via the plurality of ink flow paths, the ink contained within the plurality of ink chambers.

2. The apparatus of claim 1, wherein the plurality of ink flow paths are substantially the same length.

3. The apparatus of claim 1, wherein the ink ejection mechanism is positioned substantially below the center point.

4. The apparatus of claim 1, wherein said ink ejection mechanism is selected from the group of ink ejection mechanisms consisting of a thermal bubble system and a piezoelectric system.

5. the apparatus of claim 1, wherein each of the plurality of ink chambers comprises an ink passage positioned in close proximity to the center point.

6. The apparatus of claim 1, further comprising a manifold, and wherein each of the plurality of ink flow paths is disposed substantially vertically within the manifold.

7. The ink delivery apparatus of claim 1, further comprising a manifold operable to retain the ink ejection mechanism, wherein the manifold includes a plurality of converging ink flow paths that converge substantially horizontally towards each other as they approach the ink ejection mechanism, and wherein each of the plurality of converging ink flow paths receive ink from a corresponding ink flow path of the plurality of ink flow paths.

8. The apparatus of claim 6, wherein the plurality of ink chambers comprises four or more ink chambers, and wherein each of the plurality of ink chambers are triangular or pie-shaped.

9. The apparatus of claim 1, wherein the plurality of ink flow paths contain ink under substantially the same pressure drop.

10. The ink delivery apparatus of claim 1, wherein the plurality of ink chambers are removable.

11. An on-carrier ink delivery apparatus, comprising: a platform having a center point; a plurality of on-carrier ink chambers positioned on the platform, wherein the plurality of ink chambers substantially surround the center point, and wherein the plurality of ink chambers contain ink; a plurality of ink flow paths, wherein each ink flow path of the plurality of ink flow paths corresponds to a respective ink chamber of the plurality of ink chambers; and a centrally located ink ejection mechanism positioned substantially below the center point, said ink ejection mechanism operable to receive and eject ink stored within the plurality of ink chambers; and wherein said plurality of on-carrier ink chambers are mounted over said ink ejection mechanism.

12. The ink delivery apparatus of claim 11, wherein the plurality of ink chambers are replaceable.

13. The ink delivery apparatus of claim 12, further comprising a plurality of substantially vertical ink flow paths that transmit the ink from the plurality of chambers to the ink ejection mechanism.

14. The ink delivery apparatus of claim 13, further comprising a manifold positioned substantially above the ink ejection mechanism, and wherein the plurality of ink flow paths are contained by the manifold.

15. The ink delivery apparatus of claim 13, further comprising a plurality of substantially horizontal ink flow paths that transmit the ink from the plurality of chambers to the ink ejection mechanism via a manifold operable to retain the ink ejection mechanism.

16. The ink delivery apparatus of claim 14, wherein the plurality of ink paths extend through the height of the manifold, and wherein the plurality of ink paths converge towards each other at a bottom of the manifold.

17. The apparatus of claim 13, wherein each of the plurality of ink chambers comprises an ink passage positioned in close proximity to the center point.

18. The apparatus of claim 13, wherein said ink ejection mechanism is selected from the group of ink ejection mechanisms consisting of a thermal bubble system and a piezoelectric system.

19. An on-carrier ink delivery apparatus, comprising:

a printhead having an ink ejection mechanism;

at least four on-carrier ink chambers mounted over the printhead and positioned to encircle a common point associated with the printhead; and a plurality of ink flow paths of substantially equal length, wherein each ink flow path of the plurality of ink flow paths corresponds to a respective ink chamber, wherein the ink ejection mechanism is operable to receive and eject ink stored within the plurality of ink chambers via the plurality of ink flow paths of substantially equal length.

20. The ink delivery apparatus of claim 19, wherein the at least four ink chambers are replaceable.

21. The ink delivery apparatus of claim 19, wherein the at least four ink chambers are positioned to substantially form a shape selected from the group of shapes consisting of a circle, a semicircle, a square, a rectangle and a polygon.

22. The ink delivery apparatus of claim 19, wherein the at least four ink chambers are positioned to encircle a common point.

23. The ink delivery apparatus of claim 19, further comprising a plurality of substantially vertical ink flow paths that transmit the ink from the at least four ink chambers to the ink ejection mechanism.

24. The ink delivery apparatus of claim 23. further comprising a manifold positioned substantially above the ink ejection mechanism, wherein the plurality of ink flow paths extend through the height of the manifold, and wherein the plurality of ink paths converge towards each other at a bottom of the manifold.

25. The ink delivery apparatus of claim 19, further comprising a plurality of substantially horizontal ink flow paths that transmit the ink from the at least four ink chambers to the ink ejection mechanism via a manifold operable to retain the ink ejection mechanism.

26. A method for on-carrier ink delivery, comprising: positioning a plurality of on-carrier ink chambers to be mounted over a printhead and around a center point associated with the printhead; transmitting, via substantially vertical ink paths, ink stored within the plurality of ink chambers to a centrally located ink ejection mechanism positioned below the center point; and ejecting the ink from the ink ejection mechanism.

* * * * *